United States Patent [19]

Funato et al.

[11] Patent Number: 5,024,914

[45] Date of Patent: Jun. 18, 1991

[54] RESIN FOR TONER PARTICLE

[75] Inventors: Ryo Funato, Nagoya; Syuji Takahiro, Kasugai; Keiji Yoshida, Nagoya; Shinji Kubo, Toyohashi; Motoshi Inagaki, Nagoya, all of Japan

[73] Assignee: Mitsubishi Rayon Company Limited, Tokyo, Japan

[21] Appl. No.: 422,772

[22] Filed: Oct. 17, 1989

[30] Foreign Application Priority Data

Oct. 18, 1988 [JP] Japan ..... 63-290224

[51] Int. Cl.[5] ..... G03G 9/087

[52] U.S. Cl. ..... 430/109

[58] Field of Search ..... 430/109, 137

[56] References Cited

U.S. PATENT DOCUMENTS

| | | | |
|---|---|---|---|
| 4,304,843 | 12/1981 | Manger et al. | 430/109 |
| 4,592,990 | 6/1986 | Takagi et al. | 430/137 |
| 4,849,318 | 7/1989 | Tsubota et al. | 430/137 |

*Primary Examiner*—John Goodrow

*Attorney, Agent, or Firm*—Oblon, Spivak, McClelland, Maier & Neustadt

[57] ABSTRACT

A resin for toner containing fine particles with a particle size passing through a 200 mesh sieve of not greater than 10% by weight.

6 Claims, No Drawings

RESIN FOR TONER PARTICLE

BACKGROUND OF THE INVENTION

1. Field of the Invention

The present invention relates to a resin for toner. In particular, the invention concerns a resin for toner having improved offset resistance and long life as well as excellent productivity.

2. Description of the Prior Art

In recent years, along with propagation of copying machines or laser beam printers using toners amount of toners used therein has been increased rapidly, and there has been a strong demand in the market for developing toners which can be prepared in high productivity at low cost.

However, the production steps for toner is extremely complicated, requiring preliminary mixing of a binder resin and additives, melt-kneading, coarse pulverization, fine pulverization and sieving. Since the pulverization steps are rate-determining steps of the process for preparing the toner, development of a resin that can be pulverized easily in the pulverization steps has been highly desired. Development has also been making for a resin of satisfactory pulverization property (pulverizability) and, it has been disclosed in, for example, Japanese Patent Laid Open 195681/1987 to reduce molecular weight of the resin or to lower cross linking density thereby lowering melt viscosity of the resin.

However, toners prepared by these methods present a so-called offset phenomenon in which toner particles are stuck to the surface of a fixing roller upon fixing the toners to paper sheets, or toner-life is worsened in which succeeding copy sheets are contaminated, mechanical abrasion resistance of the toners is lost and toner characteristics are worsened in the copying machine after copying tens of thousands of sheets.

During the course of a study for preparing toners free from such disadvantage, it has been found that if the content of fine particles contained in a resin for toner is controlled to less than a certain amount when preparing the resin by suspension polymerization, the pulverizability of the toner can be improved and, accordingly, if the softening point of the resin is increased to such an extent as causing no offset phenomenon, the toner life can also be improved without worsening the fixing property so much.

SUMMARY OF THE INVENTION

The present invention is to provide a resin for toner wherein the resin comprises particulate polymers prepared by suspension polymerization and the content of particles having particle size passing through a 200 mesh sieve is lower than 10% by weight in the resin. The resin for toner in accordance with this invention preferably has a softening point Ts higher than 120° C. In the present invention, the term "resin" means a resin for toner.

DETAILED DESCRIPTION OF THE PREFERRED EMBODIMENTS

The resin according to the present invention comprises particulate or granular polymers obtainable by suspension polymerization. The suspension polymerization is conducted by a known method till the polymerization is substantially completed. At first, water of 1 to 10 times, preferably, 2 to 4 times of the monomer, a suspension-dispersant and, if required, a dispersion aid are charged and stirred in a reactor equipped with a thermometer. Then, a monomer, a polymerization initiator and, if required, a chain transfer agent are added at an ambient temperature or under heating and heated up to a predetermined polymerization temperature. The temperature is kept till the polymerization is substantially completed, that is, at least 95% of the monomer is converted to polymer.

The monomer used for the preparation of the resin according to the present invention may be any monomers so long as they have been used as monomers to prepare the resin and are capable of radical polymerization through suspension polymerization. Exemplary monomers include styrene, α-methyl styrene, styrene derivatives having, as a substituent, o-methyl group, m-methyl group, p-methyl group, p-ethyl group, 2,4-dimethyl group, p-butyl group, p-hexyl group, p-octyl group, p-nonyl group, p-decyl group, p-methoxy group and p-phenyl group, acrylic acid or methacrylic acid esters represented by the general formula: $CH_2=CR—COOR'$ in which R represents hydrogen or methyl group and R' represents a substituted or not-substituted alkyl group or aromatic group such as methyl group, ethyl group, n-propyl group, isopropyl group, n-butyl group, isobutyl group, sec-butyl group, t-butyl group, n-pentyl group, n-hexyl group, n-octyl group, 2-ethyl hexyl group, n-nonyl group, isononyl group, decyl group, dodecyl group, tridecyl group, stearyl group, dococyl group, cyclohexyl group, benzyl group, phenyl group, methoxy ethyl group, ethoxy ethyl group, buthoxy ethyl group and phenoxy ethyl group, vinyl esters such as vinyl acetate and vinyl propyonate and other acrylic acid or methacrylic acid derivatives such as acrylonitrile and methacrylonitrile. They may be used alone or as a mixture of two or more of them. Suitable example of the mixture includes a mixture containing styrene and/or derivative thereof and a mixture containing (meth) acrylic acid alkyl ester as the main component.

In the present invention, a monomer having at least two polymerizable vinyl groups in one molecule (hereinafter this monomer is referred to as a cross linking monomer) may be used together with the monomer mentioned above. The resin obtained by such a monomer mixture system as containing the cross linking monomer can remarkably improve the offset resistance of the toner when it is used in copying machines adopting heat roller fixing system. Specific examples of the cross linking monomer are aromatic divinyl compounds such as divinyl benzene, divinyl naphthalene and derivatives thereof, diacrylate or dimethacrylate of dihydric alcohol, such as ethylene glycol, 1,3-butanediol, 1,4-butanediol, 1,6-hexanediol, neopentyl glycol, diethylene glycol, triethylene glycol, tetraethylene glycol and polyethylene glycol.

In the present invention, it is possible to improve the offset resistance by setting the resin softening temperature Ts of the resin to higher than 120° C. For obtaining the resin with a long life, it is desirable to use the cross linking monomer with other vinyl monomer. However, if the amount of the cross linking monomer is too much, the pulverizability and the fixing property of the toner prepared by using the resin are worsened and, accordingly, the amount of the cross linking monomer to be copolymerized is determined in relation with chemical composition of the monomers for the resin.

Known polymerization initiator may be used for preparing the resin according to the present invention. Exemplary initiators include di-t-butyl peroxide, t-butyl cumyl peroxide, dicumyl peroxide, acetyl peroxide, isobutylyl peroxide, octanonyl peroxide, decanonyl peroxide, lauloyl peroxide, 3,5,5-trimethyl hexanoyl peroxide, benzoyl peroxide, m-toluoyl peroxide, t-butyl peroxiacetate, t-butyl peroxiisobutylate, t-butyl peroxipivalate, t-butyl peroxineodecanoate, cumyl peroxineodecanoate, t-butyl peroxi 2-ethyl hexanoate, t-butyl peroxi 3,5,5-trimethyl hexanoate, t-butyl peroxilaurate, t-butyl peroxibenzoate, t-butyl peroxiisopropyl carbonate, azobisisobutylonitrile, 2,2'-azobis-(2,4-dimethyl valelonitrile), etc. They may be used alone or as a mixture of two or more of them. Among them, use of octanonyl peroxide, decanonyl peroxide, lauroyl peroxide, benzoyl peroxide and m-toluoyl peroxide is preferred in view of keeping polymerization activity to the monomer and the completion of the polymerization in a relatively short period of time.

If the amount of the initiator is insufficient, the softening temperature of the resultant resin is raised and the pulverizability of the resin is worsened, as well as the fixing property of the toner prepared by such resin is worsened. On the contrary, if the amount of the initiator is too much, the softening temperature of the resin Ts is lowered to less than 120° C and the offset resistance is reduced or the life time become poor for the toner prepared by using the resin.

Known suspension-dispersants are used for preparing the resin according to the present invention through the suspension polymerization. Specific examples are polyvinyl alcohol, partially saponified polyvinyl alcohol, sodium salt or potassium salt of acrylic or methacrylic acid homopolymer or copolymer, water soluble resins such as carboxy methyl cellulose, gelatine or starch, less or not water soluble inorganic powders such as barium sulfate, calcium sulfate, barium carbonate, calsium carbonate, magnesium carbonate and calsium phosphate. The suspension-dispersants are used in an amount required for completing operation without coagulating polymer particles formed by polymerization of monomer during the polymerization and subsequent alkali treatment, and it is used, generally, from 0.01 to 5 parts by weight and, preferably, from 0.05 to 2 parts by weight based on 100 parts by weight of water. Further, the dispersion aid used, as required, in the present invention, can include electrolytes such as sodium chloride, potassium chloride, sodium sulfate and potassium sulfate.

The amount of the suspension dispersant to be used has a close relationship with the particle size distribution of the polymer particles in the resin and it is preferred to previously determine a relationship between the amount of the suspension-dispersant and the particle size distribution and then determine the amount of the suspension-dispersant such that the content of the fine polymer particles passing through a 200 mesh sieve having a sieve opening of 74 $\mu$ is lower than 10% by weight.

The content of the fine polymer particles passing through the 200 mesh sieve can be controlled to lower than 10% by weight also by changing the mechanical condition such as the rate of stirring during suspension polymerization or by sieving the resultant resin comprising polymer particles. In the resin, by controlling the content of the fine polymer particles passing through the 200 mesh sieve to lower than 10%, the pulverizability upon producing the toner by using such resin can be improved and also the melt-kneading property is improved, and further the productivity of the toner can be improved remarkably as compared with that in the toner production process developed so far, although the reason therefore is not clear.

Further, the toner prepared by using the resin according to the present invention has an advantageous feature that the offset resistance is excellent while possessing satisfactory toner fixing property and the tendency can be recognized well if the softening temperature Ts of the resin is set to higher than 120° C.

EXAMPLE

The following examples are given as specific illustration of the claimed invention. It should be understood, however, that the invention is not limited to the specific details set forth in the examples. In examples, "parts" mean "parts by weight". Various estimations in the examples were conducted by the methods shown below:

Softening temperature Ts

Using a flow tester (Model: FT-500A, manufactured by Shimazu Corporation), one gram of a resin was caused to flow out from a nozzle 1 mm$\phi$ and 10 mm length under a load of 30 kg and at a temperature increasing rate of 3° C/min. Then, the softening temperature Ts was defined as a temperature at which the amount of the resin flown out reached 0.5 g.

Pulverizability

Using a twin shaft extruder, 94 parts of a resin, 5 parts of carbon black (#40, manufactured by Mitsubishi Kasei Corporation) and one part of charge controller (Bontron S-34, manufactured by Orient Chemical Industry Co., Ltd.) were kneaded at 150° C for about 5 min and, after cooling, coarsely pulverized so as to unify the particle size to about 2 mm$\phi$. A predetermined amount of the toners which are previously designed so as to become 11 $\mu$m of volume average particle size were charged to a supersonic jet pulverizer (Labojet: manufactured by Nihon Pneumatic Industry Co., Ltd.) and the pulverizability was estimated based on the relative yield (pulverization speed) of the resultant toner after 10 min.

If the relative yield is lower than 0.8, the toner pulverizability is too poor to use the toner commercially in view of the productivity.

If the relative yield ranges from 1.0 to 1.5, the toner productivity is satisfactory and the yield is good, with no excess pulverization.

If the relative yield is greater than 1.5, the toner is pulverized somewhat excessively to reduce the yield.

(Relative yield of the resin of Example 3 hereinafter described is 1.0)

Life

From a developer used for a negatively charging PPC copying machine operating at 40–50 sheet/min (DC-5132, manufactured by Mita Industrial Co., Ltd.), only the toner was replaced with a test toner. Contaminations on white areas and image density on copy papers after copying of ten thousands of sheets were visually observed and collectively estimated.

O: No substantial contamination on white areas and no reduction in image density Δ: Some contamination on white areas, and some reduction in the image density, at the limit of practical use X: Remarkable contaminations on white area, impossible to practical use

COMPARATIVE EXAMPLE 1

300 parts of water and 0.3 parts of Gosenol GH-20 (partially saponified Poval, manufactured by Nippon Synthetic Chemical Industry Co., Ltd.) as a suspension-dispersant were added to a reactor and well stirred to mix.

Then, 83 parts of styrene, 17 parts of 2-ethyl hexyl acrylate, 0.3 parts of divinyl benzene as the pure content and 4 parts of benzoyl peroxide, as the polymerization initiator, were mixed at an ambient temperature, and the mixture was added to a reactor. Then, the temperature in the reactor was elevated to 88° C and polymerization was conducted for 5 hours. Then, after cooling, the reaction product was filtered and the resultant polymer particles were washed and dewatered to obtain a particulate resin (R1). The softening temperature Ts of (R1) was 125° C.

The resin (R1) was well-sieved by using a 200 mesh Tyler standard sieve in a sieving tester equipped with a motor, to remove fractions of particles which pass through 200 mesh to obtain a resin (R2). By measuring the weight of the passed fine particles, it was confirmed that (R1) contained 13% by weight of 200 mesh sieve passing fractions.

When pulverizability was measured for (R1), the relative yield was extremely poor as low as 0.5. After removing less than 5 μm fractions by a sieve from the resultant toner used for measuring the pulverizability, the thus prepared toner specimen was measured for life to be estimated satisfactory as "(O)".

EXAMPLE 1

When the softening temperature Ts of the resin (R2) obtained in Comparative Example 1 was measured, it was 125° C. Further, when the pulverizability was measured for the resin (R2), it was extremely satisfactory as high as 1.4 and the result of the measurement for the life was also satisfactory as "(O)".

EXAMPLE 2

Upon sieving the resin (R1) through the 200 mesh sieve, the sieving time was so controlled that the remaining polymer particles which pass 200 mesh was 8% by weight based on the total amount of the resin to obtain a particulate resin (R3).

When the pulverizability was measured for the resin (R3), the relative yield was somewhat satisfactory as 1.1 and the life was also good.

COMPARATIVE EXAMPLE 2

A particulate resin (R4) was obtained in the same procedures as in Comparative Example 1 except for increasing the amount of benzoyl peroxide (polymerization initiator) from 4 parts to 5 parts.

The softening temperature Ts of the resin (R4) was 115° C. When the pulverizability was measured for the resin (R4), although the relative yield was good as 1.3, the life was poor as "X" and thus the resin (R4) could not be used as toner.

EXAMPLE 3

A particulate resin (R5) was obtained in the same procedures as in Example 2 except for changing the content of the fine particles passing through the 200 mesh sieve from 8% by weight to 10% by weight in the polymer particles prepared by suspension polymerization in the same manner as in Comparative Example 1 except for increasing the amount of the benzoylperoxide (polymerization initiator) from 4 parts to 4.5 parts. The softening temperature (Ts) of the resin (R5) was 120° C. When the pulverizability was measured using the resin (R5), the relative yield was 1.0 and the life was at the limit for the commercial use as toner.

The foregoing results are collectively shown in Table 1.

TABLE 1

| | Resin | 200 mesh sieve pass wt % | Softening temperature (Ts) °C. | Pulverizability (relative yield) | Toner life |
|---|---|---|---|---|---|
| Example 1 | R2 | 0 | 125 | 1.4 | O |
| Example 2 | R3 | 8 | 125 | 1.1 | O |
| Comparative Example 1 | R1 | 13 | 125 | 0.5 | O |
| Comparative Example 2 | R4 | 8 | 115 | 1.3 | X |
| Example 3 | R5 | 10 | 120 | 1.0 | Δ |

We claim:

1. A toner resin for electrographic processes comprising particulate polymers having a softening temperature of higher than 120° C. and in which lower than 10% by weight of the polymer particles is less than 74 μ.

2. The toner resin of claim 1, wherein the content of polymers having a particle size less than 74 μ is substantially 0% in the resin.

3. The toner resin of claim 1, wherein the resin is prepared by suspension polymerization.

4. The toner resin of claim 1, wherein the resin has a softening temperature Ts of about 120° C. to about 125° C.

5. The toner resin of claim 1, wherein the resin is cross linked.

6. The toner resin of claim 1, wherein the pulverizability of the resin in terms of the relative yield is from 1.0 to 1.5.

* * * * *

UNITED STATES PATENT AND TRADEMARK OFFICE

CERTIFICATE OF CORRECTION

PATENT NO. : 5,024,914

DATED : June 18, 1991

INVENTOR(S) : Ryo Funato et al.

It is certified that error appears in the above-identified patent and that said Letters Patent is hereby corrected as shown below:

On the title page:

The Foreign Application Priority Data is incorrect, should be, -- Nov. 18, 1988 [JP] Japan .....63-290224--.

Signed and Sealed this

Third Day of November, 1992

*Attest:*

DOUGLAS B. COMER

*Attesting Officer*

*Acting Commissioner of Patents and Trademarks*